United States Patent [19]

Habesch, Jr. et al.

[11] 4,300,947

[45] Nov. 17, 1981

[54] MECHANICALLY ALLOYED POWDER PROCESS

[75] Inventors: Emil M. Habesch, Jr., Ballston Lake; John R. Rairden, Schenectady, both of N.Y.

[73] Assignee: General Electric Company, Schenectady, N.Y.

[21] Appl. No.: 191,268

[22] Filed: Sep. 26, 1980

Related U.S. Application Data

[63] Continuation-in-part of Ser. No. 91,112, Nov. 5, 1979, abandoned.

[51] Int. Cl.[3] ..... B22F 9/02

[52] U.S. Cl. ..... 75/0.5 R; 75/171; 241/16

[58] Field of Search ..... 75/0.5 R, 0.5 A, 0.5 AA, 75/0.5 AB, 0.5 AC, 0.5 B, 0.5 BA, 0.5 BB, 0.5 BC, 0.5 C, 951, 171; 241/16

[56] References Cited

U.S. PATENT DOCUMENTS

| | | | |
|---|---|---|---|
| 3,556,769 | 1/1971 | Lambert et al. | 75/0.5 AC |
| 3,723,092 | 3/1973 | Benjamin | 75/0.5 R |
| 3,734,713 | 5/1973 | Kushnir et al. | 75/0.5 AC |
| 3,741,748 | 6/1973 | Fustukian et al. | 75/0.5 AC |
| 3,853,931 | 10/1974 | Kondus | 260/448 A |
| 3,877,930 | 4/1975 | Volin | 75/0.5 R |
| 3,964,877 | 6/1976 | Bessen et al. | 75/171 |
| 4,101,715 | 7/1978 | Rairden | 75/171 |

*Primary Examiner*—Michael L. Lewis

*Attorney, Agent, or Firm*—Stephen S. Strunck; James C. Davis, Jr.; Joseph T. Cohen

[57] ABSTRACT

An improved process for the preparation of oxidation and corrosion resistant cobalt, iron, or nickel-based alloy powders from a plurality of constituents in powdered form, by high energy mechanical alloying in an attritor-type mill, wherein at least one constituent is an active metal, such as aluminum, present as a substantial proportion of the total and is in elemental form.

7 Claims, 1 Drawing Figure

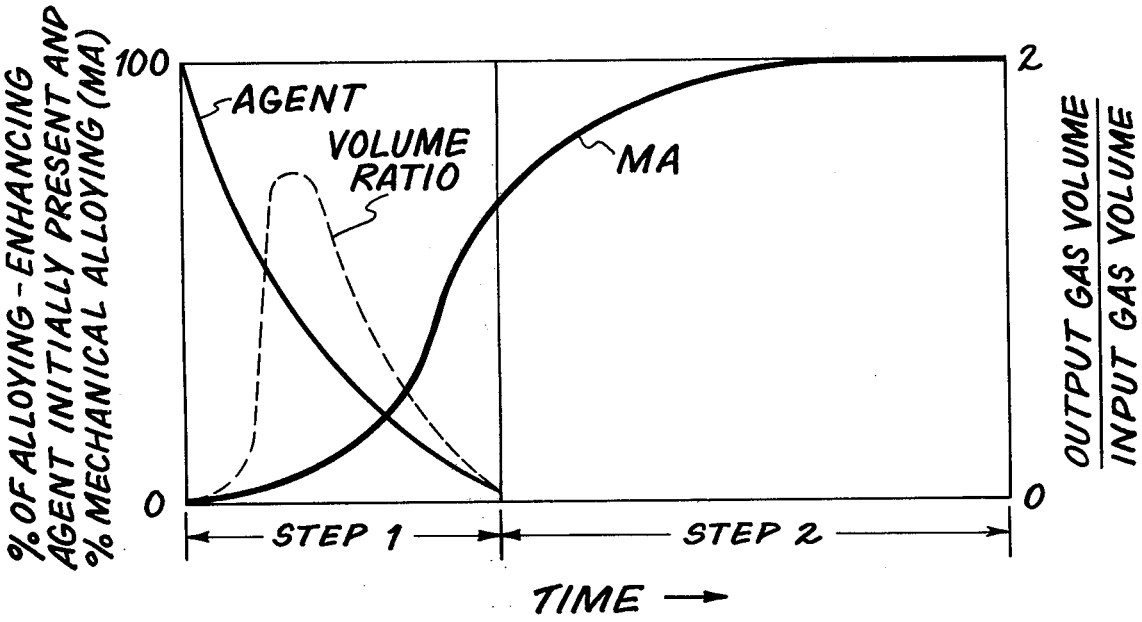
% OF ALLOYING - ENHANCING AGENT INITIALLY PRESENT AND % MECHANICAL ALLOYING (MA)
100
0
AGENT
VOLUME RATIO
MA
2
0
OUTPUT GAS VOLUME / INPUT GAS VOLUME
STEP 1
STEP 2
TIME

MECHANICALLY ALLOYED POWDER PROCESS

CROSS-REFERENCE TO RELATED PATENT APPLICATION

This application is a continuation-in-part of our copending U.S. application Ser. No. 91,112, filed Nov. 5, 1979, now abandoned, assigned to the assignee of the instant invention.

BACKGROUND OF THE INVENTION

I. Field of the Invention

This invention relates to an improved process for the preparation of oxidation and corrosion resistant cobalt, iron, or nickel-based alloy powders from a plurality of constituents in powder form, by high energy mechanical alloying in an attritor-type mill, wherein at least one constituent is an active metal, such as aluminum, present as a substantial proportion of the total and is in elemental form.

II. Description of the Prior Art

U.S. Pat. Nos. 3,591,362 and 3,723,092 issued Mar. 1, 1968 and Mar. 27, 1973, respectively, to Benjamin describe mechanically alloyed metal powders and a process for their preparation, respectively; both of which are incorporated herein by reference in their entireties.

Illustratively, Benjamin in U.S. Pat. No. 3,723,092 describes the basic steps of the mechanical alloying process as, ". . . providing a dry charge of attritive elements and a powder mass comprising a plurality of constituents, at least one of which is a metal capable of being compressively deformed, subjecting the charge to agitation milling under high energy conditions in which a substantial proportion or cross section of the charge is maintained kinetically in a highly activated state of relative motion, and continuing the milling to produce wrought composite metal powder in which particles thereof have substantially the saturation hardness for the system involved."

Benjamin further teaches that the term "mechanical alloy" applies to the state which prevails in a composite metal particle produced in accordance with his invention wherein, ". . . a plurality of constituents in the form of powders, at least one of which is a compressively deformable metal, are caused to be bonded or united together by the application of mechanical energy in the form of a plurality of repeatedly applied compressive forces sufficient to vigorously work and deform at least one deformable metal and cause it to bond or weld to itself and/or to the remaining constituents, be they metals and/or non-metals, whereby the constituents are intimately united together and indentifiably codisseminated throughout the internal structure of the resulting composite metal particles."

Benjamin teaches that a large variety of alloy powders may be made by the mechanical alloying process in which at least one of the constituents is a readily compressively deformable metal comprising at least about 15% or more by volume of the total powder composition. Thus alloy systems ranging from the simple, e.g., lead-base, aluminum-base, copper-base, nickel-base, cobalt-base, and refractory metal-base, to the complex, e.g., the well known heat resistant alloys such as those based on the nickel-chromium, cobalt-chromium, and iron-chromium systems, may be mechanically alloyed. Both the simple and more complex alloys can be produced with uniform dispersions of hard phases, such as refractory oxides and refractory carbides, nitrides, and borides, by the mechanical alloying process. In the mechanical alloying of the more complex alloys, such as the well-known heat resistant alloys, Benjamin teaches that alloying constituents such as molybdenum, tungsten, columbium and/or tantalum, aluminum, titanium, and zirconium, may be added in their elemental form, or to avoid contamination from atmospheric exposure, as master alloys or metal compound additions wherein the more reactive alloying addition is diluted or compounded with a less reactive metal such as nickel, iron, cobalt, etc.

Benjamin teaches that it is important that the milling process be conducted in the dry state and that liquids be excluded from the milling environment since they tend to prevent cold welding and particle growth of metal powder and tend to promote the formation of flakes. Benjamin notes that inert gas media tend to enhance product particle growth and may be of assistance when powder mixtures containing active metals such as aluminum, titanium, etc., are being milled. Also oxygen up to about 1% by weight in excess of that added as a refractory oxide dispersoid, preferably not exceeding about 0.75% or about 0.5% oxygen is seen as beneficial.

In U.S. Pat. No. 3,877,930, issued Apr. 15, 1975, the entirety of which is incorporated herein by reference, Volin describes the use of organic interdispersion cold bonding control agents (ICBCA) in the mechanical alloying process. Volin teaches that mechanical alloying, particularly of non-dispersion strengthened alloys of the superalloy type, conducted in the presence of an argon-nitrogen atmosphere are susceptible to several problems. For example, oxygen retained in the particles of nickel-base superalloys tend to degrade metallurgical properties such as the tensile strength and creep ductility of those alloys. If oxygen is present to an excess, comminution of the powders dominates to such an extent as to virtually preclude the critical necessary cold bonding. In the absence of oxygen-bearing atmospheres, the powders either adhere irreversibly to the attriting elements and interior attritor surfaces or, depending upon the composition of the attriting elements and powder charge, may irreversibly cold bond to form undesirably large particles.

To facilitate the mechanical alloying of alloys such as the nickel-base superalloys, Volin teaches that it is necessary to establish a "control balance" through the use of an ICBCA. ICBCAs may be selected from such compounds as, for example, methane, ethane, propane, hexane, methanol, stearic acid, and oleic acid. These ICBAs are added in the range of not more than 2–3% with a range of 0.05 or 0.1 to 0.5% and up to 2% being deemed satisfactory. It is considered by Volin that the ICBCAs establish the "control balance" by virtue of their reacting with or being adsorbed on the surfaces of the powder particles thus causing occlusion of the particles during collisional events and that this inhibits metal-to-metal bonding.

U.S. Pat. No. 4,101,713, issued July 18, 1978, to Hirsch and Rairden, the entirety of which is incorporated herein by reference, teaches the use of the high energy mechanical alloying process to produce metal powders suitable for the plasma flame spraying of superalloy articles to impart improved high temperature oxidation and corrosion resistance. Hirsch and Rairden teach the use of master alloy powders of cobalt and aluminum as starting materials for flame spraying powders that have aluminum as a substantial consituent.

Hirsch and Rairden also teach recovery of the milled powder by use of a raised perforated bottom plate.

Despite the prior art teachings, the production of alloy powders by the mechanical alloying process, wherein at least one of the constituent powders is an active metal, such as aluminum, present as a substantial proportion of the total and is in elemental form has been found to produce an inhomogeneous product and result in low yield of the small-sized powders particularly suitable for plasma flame spraying.

Therefore, it is an object of this invention to provide an improved method for producing mechanically alloyed powder wherein at least one of the starting constituent powders is aluminum or other active metal, present as a substantial proportion of the total and is in elemental form.

A further object of this invention is to provide an improved method for increasing the yield of small-sized mechanically alloyed powders suitable for plasma flame spraying applications wherein at least one of the starting constituent powders is aluminum, or other active metal present as a substantial proportion of the total and is in elemental form.

Another object of this invention is to increase the total yield of alloy powder recovered from attritor-type mills.

Other objects of this invention will, in part, be obvious and will, in part, appear hereinafter.

SUMMARY OF THE INVENTION

In accordance with the teachings of this invention there is provided an improved process for the preparation of alloy and superalloy powders from a plurality of constituents in powder form, by high energy mechanical alloying in an attritor type mill, wherein at least one constituent is an atmospherically active metal, such as aluminum, present as a substantial proportion of the total and is in elemental form. The powders produced by the improved process are particularly suitable for use in plasma spray apparatus.

Briefly described, the improved process comprises the steps of mechanically alloying the alloy constituents in a controlled continuously decreasing presence of an alloying-enhancing agent to the point of substantial absence of the agent proceeding in continuous sequence thereafter with dry mechanical alloying of the constituents forming thereby an alloy in powdered form, wet mixing and stripping the alloy powder in the presence of a quantity of an alloying-enhancing agent sufficient to completely entrain the alloy powder, and recovering the alloy powder.

BRIEF DESCRIPTION OF THE DRAWING

The invention is more clearly understood from the following description taken in conjunction with the accompanying drawing in which:

FIG. 1 is a schematic representation of the controlled continuous decrease of the alloying-enhancing agent in stage 1 and the resulting controlled continual increase in the percentage of mechanical alloying through the course of continuous and sequential stages 1 and 2 of the improved process.

DESCRIPTION OF THE PREFERRED EMBODIMENTS AND BEST MODE PRESENTLY CONTEMPLATED

In accordance with the teachings of this invention, the constituents to be processed are charged to a high energy attritor-type mill. The constituents may be those required to form any alloy taught by the prior art as suitable for processing by the mechanical alloying process with the proviso that a substantial proportion, i.e., about 1% to about 10%, of the total is an active element, such as aluminum, present in elemental form. Many such alloys are set forth, for example, in the previously referred to U.S. Pat. Nos. 3,723,092; 3,877,930; and 4,101,413. The sizes and shapes of the constituent powders are also selected or prepared in accordance with the teachings of the prior art.

Next, an alloying-enhancing agent is added to the attritor mill and the mill sealed. A positive flow of an oxygen-bearing inert gas is established through the mill and the operation of the mill is initiated. The input and output flows are monitored using conventional flowmeters. Soon after the operation of the mill is initiated, the contents of the mill will heat gradually due to the change of the kinetic energy of the attritor elements into thermal energy and sensible heat. Due to the increase in temperature, the alloying-enhancing agent will vaporize and its presence in the effluent gas stream indicated by an increased reading on the output flowmeter. The reading of the output flowmeter will increase to a maximum and then decrease to the point where the input flow again equals the output flow. At that point, which takes from about 3 to about 7 hours depending on the charge and operating parameters of the attritor mill, the first stage is considered complete and the second stage immediately commences without interruption and continues for from about 13 to about 17 hours. For most of the alloy systems investigated in the course of the making of this invention, an optimum yield of fine, e.g. −400 mesh (37$\mu$), alloyed powder was obtained when the second stage lasted for about 15 hours. Those skilled in the art will appreciate that control over the gradual decrease in the presence of the alloying-enhancing agent will be a function of the gas flow rate as well as the flow of cooling media through attritors equipped, and operated, with the necessary means, such as external jackets, for circulating such cooling media. In the practice of this invention, gas and cooling media flow will preferably be adjusted to conduct the first stage process in at least about 3 hours, but not more than about 7 hours.

At the end of the second stage, the attritor mill is stopped and charged with a quantity of an alloying-enhancing agent sufficient to immerse the chain within the mill. With the oxygen-bearing carrier gas still flowing, the mill is again started and wet mixing, or stripping, is initiated and continued for about 1 to about 2 hours.

Upon completion of the stripping stage, the mill is stopped and partially disassembled. The mixing arm is removed and washed with additional quantities of the alloying-enhancing agent which is collected in the mill. The contents of the mill are then poured into a stainless steel collecting tray, the interior of the mill washed with additional agent, with the washings also collected in the tray, and the attritor elements removed from the tray and washed with additional agent which is also collected in the tray. The attritor elements are dried and weighed, the surplus agent decanted from the tray and the remaining alloy powder dried in an oven and sized.

The gradual controlled continuous decrease in the presence of alloying-enhancing agent during the first stage and the controlled gradual and continuous increase in the mechanical alloying during the first two stages are shown schematically in FIG. 1. It is considered that the beneficial results of this invention evidenced, in part, by the large yield of alloy powders of −400 mesh size, are due to the gradual controlled nature with which mechanical alloying is initiated in the first stage. The alloying-enhancing agent controllably slowly increases the rate of aluminum particle-to-aluminum particle welding and work hardening of aluminum thereby gradually increasing the attriting and alloying. Another beneficial, and unexpected, result of the improved process is the improved total yield of powder above that experienced using the prior art raised perforated bottom plate. Alloyed powders produced by the novel improved method of this invention have morphologies similar to that shown in FIG. 1 of U.S. Pat. No. 4,101,713; however, by microprobe analysis, aluminum initially present in elemental form will be discernable as such in contradistinction to aluminum initially present as a master alloy.

It has been found that methanol is a particularly effective alloying-enhancing agent. However, it is within the contemplation of this invention that other volatile hydrocarbons, alcohols, water, and surface active agents, such as stearic and oleic acids, or mixtures thereof will also suffice. These agents are preferably added in the range of about 1 ml per each 8 to 17 grams of powdered constituents. Argon flowing at about 1 scfh and containing about 100 to 200 ppm of oxygen was found to be a particularly suitable oxidizing agent.

The following illustrative, but not limiting, examples of the novel improved process as actually carried out, wherein all materials are expressed on a weight percent basis, with the new results indicated above will further inform those skilled in the art of the nature and special utility of this invention.

EXAMPLE I

Preparation of a Co-29Cr-6Al-1Y alloy powder

The following amounts of powders of the following elements and combination of elements:

| | |
|---|---|
| 100% Co | = 509.8 gm |
| 100% Cr | = 243.6 gm |
| 100% Al | = 50.4 gm |
| 76.8% Co-23.2% Y | = 36.2 gm |

were charged to a high energy Type 1S (2 gallon capacity) Attritor Mill mamnufactured by Union Process, Inc., Akron, Ohio. The attritor contained ~ 35 lb of Ni balls approximately ¼ in. in diameter. As for all the examples herein, a flow of cooling water of about 1 gal/min was established through the external cooling jacket of the mill. Then, 100 ml of methanol was added to the powder charge and the resulting mixture was mechanically alloyed at 175 rpm under a positive flow of 1 scfh argon containing ~ 100 ppm $O_2$. The input and output flows of argon were initially identical, the output flow increased to a peak in about 1½ hours and became equal again in about 7 hours at which time the first stage was considered complete and processing continued without interruption into stage 2. The resulting alloy was further mechanically alloyed in the substantial absence of methanol under 1 scfh of flowing argon containing ~ 100 ppm oxygen for about an additional 14 hours at 175 rpm.

Next, for stage 3, 1800 milliliters of methanol sufficient to cover the entire charge in the mill was added to the attritor and wet mixing and stripping was carried out in 1 scfh of flowing argon containing ~ 100 ppm oxygen for an additional one hour at 175 rpm.

The resulting powder was washed free from the attritor and nickel balls with additional methanol, dried at temperatures above 100° C. in an explosion proof furnace, and screened to yield a high fraction, i.e. 89.6%, of −400 mesh (less than 37 microns) powder. The amount of powder recovered was 98.9% of the ingredients originally charged to the attritor mill.

EXAMPLE II

Preparation of a Ni-20Cr-5Al-0.1Y-0.1C alloy powder

A powder charge consisting of:

| | |
|---|---|
| 100% Ni | = 562.6 gm |
| 100% Cr | = 159.5 gm |
| 60% Ni-40% Al | = 105.0 gm |
| 76.2% Ni-23.8% Y | = 3.53 gm |
| 91% Cr-9% C | = 9.33 gm |

and 50 ml of methanol were charged to an attritor of the type employed in Example I and processed generally in accordance with the procedure of Example I. However, in this case it took about 4 hours for the output gas flow to reequilibrate with the inlet gas flow. Without interruption, the resulting powdered alloy was further and continuously mechanically alloyed in the substantial absence of methanol under flowing argon containing ~ 100 ppm oxygen for about an additional 17 hours at 175 rpm.

Then, 1800 milliliters of methanol was added to the attritor and wet mixing and stripping was carried out in flowing argon containing ~ 100 ppm oxygen for two additional hours at 175 rpm.

The resulting powder was recovered and dried as in Example I and screened to yield a high fraction, i.e. 93.1%, of −400 mesh (less than 37 microns) powder. The amount of powder recovered was 97.5% of the ingredients originally charged to the attritor mill.

EXAMPLE III

Preparation of a Fe-25Cr-10Al-1$Y_2O_3$ alloy powder

A powder charge consisting of:

| | |
|---|---|
| 100% Fe | = 537.6 gm |
| 100% Cr | = 210.0 gm |
| 100% Al | = 84.0 gm |
| 100% $Y_2O_3$ | = 8.4 gm |

plus 50 ml of methanol were charged to an attritor of the type employed in Example I and mechanically alloyed as in stage 1, of Example II. The resulting alloy was further mechanically alloyed as in stage 2 of Example II, and then wet mixed and stripped, washed, separated, and dried as in stage 3 of Example II.

The resulting powder was screened to yield a high fraction, i.e. 74.0%, of −325 mesh (less than 44 microns) powder. The amount of powder recovered was 99.3% of the ingredients originally charged to the attritor mill.

EXAMPLES IV–VII

Preparation of other powder compositions

Powder compositions, weights, percent yield of −400 mesh (less than 37 microns) powder, and amount of powder recovered as a percentage of ingredients originally charged is summarized in Table I. The alloy powders were prepared according to the process of Example II.

While the invention has been particularly shown and described with reference to several preferred embodiments thereof, it will be understood by those skilled in the art that various changes in form and detail may be made therein without departing from the true spirit and scope of the invention as defined by the appended claims.

TABLE I

| EXAMPLE | ALLOY COMPOSITION | POWDER CHARGE (in grams) | %-400 MESH YIELD | % YIELD |
|---|---|---|---|---|
| IV | Co-29Cr-6Al-0.2$Al_2O_3$ | 544.32 – 100%Co<br>243.60 – 100%Cr<br>50.40 – 100%Al<br>1.68 – 100%$Al_2O_3$ | 99.5 | 97.4 |
| V | Co-29Cr-6Al-0.2$Y_2O_3$ | 544.32 – 100%Co<br>243.60 – 100%Cr<br>50.40 – 100%Al<br>1.68 – 100%$Y_2O_3$ | 79.2 | 97.2 |
| VI | Co-29Cr-5Al 1$Al_2O_3$-1Y | 509.79 – 100%Co<br>243.60 – 100%Cr<br>42.00 – 100%Al<br>8.40 – 100%$Al_2O_3$<br>36.20 – 76.8%Co/23.2%Y | 79.8 | 93.5 |
| VII | Ni-4Co-18Cr-5Al 0.8Ti-6.3Ta-0.08C-3.2Re-0.5$Y_2O_3$ | 523.00 – 100%Ni<br>34.40 – 100%Co<br>144.80 – 100%Cr<br>39.30 – 100%Al<br>6.97 – 100%Ti<br>52.80 – 100%Ta<br>7.47 – 91%Cr/9%C<br>27.10 – 100%Re<br>4.20 – 100%$Y_2O_3$ | 91.5 (−325 mesh) | 103.4 (>100% due to pickup from Ni attritor balls) |

We claim as our invention:

1. In the process for preparing alloy and superalloy powders from a plurality of constituents in powdered form, at least one of which is an atmospherically active element, present as a substantial proportion of the total of said constituents and in elemental form, by mechanical alloying in an attritor-type mill the improvement which comprises:

(a) mechanically alloying said constituents in a controlled continuously decreasing presence of an alloying-enhancing agent followed sequentially and without interruption of the process at the point of substantial absence of said agent by;

(b) dry mechanically alloying said constituents forming thereby an alloy in powdered form;

(c) wet mixing and stripping said alloy powder in the presence of an alloying-enhancing agent, said agent being substantially present during said mixing and stripping in a quantity sufficient to completely engulf said alloy powder; and (d) recovering said alloy powder.

2. The improved process of claim 1 wherein a positive flow of gas is maintained through said mill during said mechanically alloying, dry mechanically alloying, and wet mixing and stripping stages, said flow of said gas aiding in establishing said controlled continuously decreasing presence of said agent during said mechanically alloying stage.

3. The improved process of claim 1 wherein the alloying-enhancing agent used in said wet mixing and stripping stage is the same type of alloying-enhancing agent used in said mechanically alloying stage.

4. The improved process of claim 1 wherein said alloying-enhancing agent is selected from the group consisting of methane, ethane, propane, hexane, ethylene, allene, hexane, acetylene, methanol, ethanol, ethylene glycol, formaldehyde, methyl ether, acetone, stearic acid, oleic acid, and oxalic acid and mixtures thereof.

5. The improved process of claim 4 wherein said alloying-enhancing agent is present in an amount of from about 1 ml per 8 grams of constituents to about 1 ml per 17 grams of constituents at the start of said mechanically alloying process.

6. The improved process of claim 2 wherein said gas is a mixture of an inert carrier gas and oxygen.

7. The improved process of claim 3 wherein said oxygen is present in the range of from about 100 ppm to about 200 ppm.

* * * * *